US005790931A

United States Patent [19]

Tsuji et al.

[11] Patent Number: 5,790,931

[45] Date of Patent: Aug. 4, 1998

[54] FIXING DEVICE

[75] Inventors: Masaru Tsuji, Nara; Shinichi Azumi, Yamatotakada; Kouji Yamaji, Soraku-gun; Atsushi Kadoya, Nara; Toshiaki Kagawa, Sakurai, all of Japan

[73] Assignee: Sharp Kabushiki Kaisha, Osaka, Japan

[21] Appl. No.: 902,504

[22] Filed: Jul. 29, 1997

Related U.S. Application Data

[63] Continuation-in-part of Ser. No. 697,326, Aug. 22, 1996, abandoned.

[30] Foreign Application Priority Data

Oct. 26, 1995 [JP] Japan ..... 7-278944
Sep. 27, 1996 [JP] Japan ..... 8-255651

[51] Int. Cl.[6] ..... G03G 15/20

[52] U.S. Cl. ..... 399/328; 399/320; 219/216

[58] Field of Search ..... 399/320, 328, 399/330; 219/216

[56] References Cited

U.S. PATENT DOCUMENTS

| | | | |
|---|---|---|---|
| 4,822,978 | 4/1989 | Morris et al. | 399/334 |
| 5,485,259 | 1/1996 | Uehara et al. | 399/330 |
| 5,570,171 | 10/1996 | Kusumoto et al. | 399/328 |
| 5,621,512 | 4/1997 | Uehara et al. | 399/328 |
| 5,655,202 | 8/1997 | Yoshimura et al. | 399/330 |
| 5,708,947 | 1/1998 | Kagawa et al. | 399/328 |

FOREIGN PATENT DOCUMENTS

| | | | |
|---|---|---|---|
| 55-36996 | 9/1980 | Japan . | |
| 60-143374 | 7/1985 | Japan | 399/330 |
| 5-11959 | 5/1993 | Japan . | |
| 8-063016 | 3/1996 | Japan . | |
| 8-115004 | 5/1996 | Japan | 399/330 |
| 8-241000 | 9/1996 | Japan | 399/330 |
| 9-179428 | 7/1997 | Japan . | |

*Primary Examiner*—Matthew S. Smith
*Attorney, Agent, or Firm*—David G. Conlin; David D. Lowry

[57] ABSTRACT

A heat-resistant sheet, which has slits formed therein, is provided between a fixing roller and a pressure member. The heat-resistant sheet, which has a thickness of 300 μm, is coated with a synthetic resin material having superior toner-releasing and heat-resisting properties, or incorporates such a synthetic resin material inside thereof. Here, a recording material is transported between the fixing roller and the heat-resistant sheet. As the surface temperature of the fixing roller rises, the heat-resistant sheet starts expanding gradually, causing its surface to be warped. However, unless the temperature of the fixing roller exceeds a set temperature, the expansion of the heat-resistant sheet and its surface deflection are all absorbed by the slits, and the slit width becomes zero. Therefore, it is possible to keep an optimal nip width while maintaining a proper applied pressure of the pressure member, without the necessity of using a heat-releasing device or increase the thickness of the heat-resistant sheet. As a result, a superior fixing operation is available by using the heat-resistant sheet having the slits.

25 Claims, 12 Drawing Sheets

FIXING DEVICE

This application is a continuation-in-part of application Ser. No. 08/697,326, filed on Aug. 22, 1996, now abandoned.

FIELD OF THE INVENTION

The present invention relates to a fixing device for use in apparatuses, such as electrophotographic copying machines, printers and facsimiles, wherein the electrophotographic method is adopted.

BACKGROUND OF THE INVENTION

Conventionally, the apparatuses such as electrophotographic copying machines, printers and facsimiles, using the electrophotographic method, are provided with fixing device each of which consists of a fixing roller and a pressure roller that is depressed against the fixing roller. Here, at least either the fixing roller or the pressure roller is designed to be heated. A recording material is transported between the fixing roller and the pressure roller and an image is fixed onto the recording material. This method is generally referred to as the roller method.

In the roller method, however, the paired rollers have to be rotated in synchronism with each other. Further, the rollers have to be supported so that the rollers are free to rotate respectively. The resulting problems with the fixing device are a complicated structure of the device, high costs in the device itself and bulkiness of the device.

In order to solve the above-mentioned problems, for example, Japanese Examined Patent Publication 36996/1980 (Tokukosho 55-36996) discloses a pressure pad method wherein a non-rotational depressing member is used in place of the pressure roller. In the pressure pad method, the depressing member is depressed against the fixing roller, and a recording material is transported between the fixing roller and the depressing member at which a fixing operation is carried out. FIG. 13 shows one example of the fixing device using the pressure pad method.

A fixing roller 112 is constituted of a hollow roller **112*a* made of aluminum, and a coating layer 112*b* with which the circumferential surface of the hollow roller 112*a* is coated. The coating layer 112*b* is made of a material having a high coefficient of friction, such as, for example, silicone rubber. A depressing member 111 is installed below the fixing roller 112**.

A coating layer 114, made of a material having a low coefficient of friction, for example, such as tetrafluoroethylene resin is formed on a depressing surface of the depressing member 111, that is, the surface facing the fixing roller 112. The depressing member 111, which is fixed to the upper surface of a pressing plate 116 supported by a shaft 117, is depressed onto the fixing roller 112 through the coating layer 114 by a predetermined pressure applied by a pressure spring 118. A sheet of paper 101 bearing a prefixed toner image 102 is transported between the fixing roller 112 and the depressing member 111, and the prefixed toner image 102 is thus fixed onto the sheet of paper 101.

Moreover, Japanese Laid-Open Patent Publication 1-304481/1989 (Tokukaihei 1-304481) discloses a pressure sheet method wherein a pressure web member is used in place of the pressure roller. In the pressure sheet method, the pressure web member is pressed against the fixing roller at a predetermined wrapping angle, and a recording material is transported between the fixing roller and the pressure web member, and thus subjected to a fixing operation. FIG. 14 shows one example of the fixing device using the pressure sheet method.

A fixing roller 122 is constituted of a hollow roller **122*a* made of aluminum, and a coating layer 122*b* with which the circumferential surface of the hollow roller 122*a* is coated. The coating layer 122*b* is made of a material having a high coefficient of friction, such as, for example, silicone rubber. One end of a pressure web member 121 is engaged and stopped by a frame 123. The other end on the opposite side is, on the other hand, pulled by a coil spring 128 with a predetermined tension. Thus, the pressure web member 121 is pressed against the fixing roller 122 at a predetermined wrapping angle $\alpha$. A sheet of paper 101 bearing a prefixed toner image 102 is transported between the fixing roller 122 and the pressure web member 121, and the prefixed toner image 102 is thus fixed onto the sheet of paper 101**.

However, in the above-mentioned fixing device using the pressure pad method, the following problems have been presented.

(1) Since the adhesive strength between the depressing member 111 and the coating layer 114 is weak, the coating layer 114 is easily worn and separated by the sliding motion against the fixing roller 112.

(2) Prior to feeding of a sheet of paper 101, or at the time before the next paper 101 is fed in the case when sheets of paper 101 are successively fed, the fixing roller 112 tends to cut and damage the depressing member 111 by its rotation, thereby causing the depressing member 111 to be deformed.

(3) In order to increase the adhesive strength between the depressing member 111 and the pressure plate 116, when the adhesive area between them is increased, the depressing member 111 becomes bulky, thereby increasing costs of the device.

(4) When the hardness of the depressing member 111 is too high, a sufficient nip width (a width which a region where the fixing roller 112 and the depressing member 111 come into contact has in the rotational direction of the fixing roller 112) is not obtained, thereby occasionally causing fixing irregularities in the roller-axial direction of the fixing roller 112. In contrast, when the hardness of the depressing member 111 is too low, the depressing member 111 tends to be deformed permanently.

(5) Since the depressing member 111 is secured to the pressure plate 116, sheets of paper 101 are transported only by the transporting force of the fixing roller 112. Therefore, it is hard to transport sheets of paper 101 smoothly, and paper jams tend to occur.

(6) The coating layer **112*b* of the fixing roller 112** has to satisfy two properties, that is, a toner-releasing property and a paper-transporting property, which are contradictory to each other. For this reason, a greater transporting force is required, and it is necessary to optimize the transporting force.

Further, the following problems have been presented in the fixing device using the pressure sheet method:

(1) In order to obtain a sufficient fixing force (fixing strength), the wrapping angle a of the pressure web member 121 has to be increased with respect to the fixing roller 122. Then, the sheet of paper 101 after having been subjected to the fixing operation tends to be curled to a great degree.

(2) The pressure web member 121 tends to have an irregular pressure distribution in its roller-axis direction with respect to the fixing roller 122, thereby occasionally causing irregularities in fixing.

Further, the following problems are commonly presented in the fixing device using the pressure pad method and in the fixing device using the pressure sheet method. That is, during a double-sided printing process, when the prefixed toner image 102 bourn on its rear-surface (hereinafter, referred to as a reversed sheet) of the sheet of paper 101 is fixed thereon, the prefixed toner image 102 of the rear-surface of the sheet of paper 101 tends to be blurred (hereinafter, referred to as blurredness of image) due to the sliding motion between the rear-surface of the sheet of paper 101 and the depressing member 111 or the pressure web member 121, or the toner on the rear-surface of the sheet of paper 101 fuses to the depressing member 111 or to the pressure web member 121, causing paper jams.

SUMMARY OF THE INVENTION

The objective of the present invention is to provide a fixing device which carries out a superior fixing operation, and also has an excellent paper-carrying property with an appropriate transporting force.

In order to achieve the above-mentioned objective, the fixing device of the present invention comprises (1) a fixing roller, (2) a heat-resistant sheet, provided in contact with said fixing roller, having a thermal deformation reducing section for reducing deformation due to heat, and (3) a pressure member, depressed onto said fixing roller with said heat-resistant sheet therebetween, wherein a recording material bearing a prefixed toner image is transported between said fixing roller and said heat-resistant sheet so that the prefixed toner image is fixed onto the recording material.

In this case, the thermal deformation reducing section is composed of at least one cut section, such as a slit or a slash, for absorbing changes in the volume of the heat-resistant sheet due to thermal expansion or thermal shrinkage.

With the aforementioned arrangement, thermal deformation such as deflection or warp is reduced since the thermal deformation reducing section provided on the heat-resistant sheet absorbs (takes in) volume changes, such as expansion or shrinkage, of the heat-resistant sheet when the heat-resistant sheet is heated to a high temperature by the fixing roller during a fixing operation. Therefore, the use of a heat-releasing device, the increase in the thickness of the heat-resistant sheet, and the increase in the paper-transporting torque, which have been required in conventional devices, are no longer needed. Thus, it becomes possible to keep an optimum nip width while maintaining a proper pressuring force of the pressure member. As a result, a superior fixing operation is available by using the heat-resistant sheet having the thermal deformation reducing section.

Moreover, since the above-mentioned arrangement eliminates the necessity of having to increase the paper-transporting torque, the pressure member is free from damages caused by a shearing force that is exerted by the rotation of the fixing roller. Therefore, different from conventional arrangements, the above-mentioned arrangement makes it possible to prevent deformation of the pressure member, thereby improving the durability of the pressure member as compared with conventional arrangements.

Furthermore, since the pressure member is not subjected to such a shearing force, no consideration is required for the adhesive area for use in fixing the pressure member. Therefore, the pressure member is designed to have a minimum size required, and the compactness and cost reduction of the device can be achieved.

Moreover, by arranging the fixing device so that the fixing roller contacts the heat-resistant sheet at a center portion of the thermal deformation reducing section provided in the heat-resistant sheet, a warp of an edge part and the like of the heat-resistant sheet is prevented, and an increase in the paper transporting torque is avoided. Furthermore, when the fixing roller is heated, the heat is uniformly transmitted over the heat-resistant sheet. Thus, uniform temperature distribution is obtained and kept on the surface of the heat-resistant sheet, whereby a fixing temperature is kept stable.

In the case where the thermal deformation reducing section is composed of, for example, slits, it is preferable to design the slits of the heat-resistant sheet to tilt with respect to the transporting direction of the recording material; thus, even in the event of an imperfect fixing, for example, due to the fact that the heat-resistant sheet has been used beyond its service life, the imperfect fixing is not so conspicuous, unlike in the cases where the slits are perpendicular or parallel to the transporting direction of sheets of paper. Therefore, this arrangement makes it possible to set factors, such as the slit width, the slit intervals and the fixing-roller temperature, with a comparatively wider range, compared with the cases where the slits are perpendicular or parallel to the transporting direction of sheets of paper.

Moreover, in the case where the slits are designed to tilt with respect to the transporting direction of the recording material as described above, the friction force between the slits and the transported sheet of paper can be dispersed. This eliminates the necessity of increasing the paper-transporting torque. Consequently, it becomes possible to reduce costs of the device by miniaturizing a motor, a power source and other components, and also to reduce the power consumption. Furthermore, since the slits are designed to tilt as described above, the pressuring effect is not impaired even when the heat-resistant sheet is depressed by the pressure member. In this case, it becomes possible to improve the fixing performance of toner as compared with conventional arrangements.

Furthermore, in the case where the thermal deformation reducing section of the heat-resistant sheet is composed of a plurality of slits, and slashes provided between the slits in parallel to the slits, even if thick sheets of paper, such as envelopes and post cards, are transported, slight deflection and distortion occurring in the heat-resistant sheet are absorbed by the slashes. Consequently, it becomes possible to prevent imperfect fixing that might occur at portions of the heat-resistant sheet with which the edges of the paper come into contact. Therefore, even in the case when thick sheets of paper are transported, it is possible to prevent deflection and distortion of the heat-resistant sheet, and to positively carry out a superior fixing operation.

For a fuller understanding of the nature and advantages of the invention, reference should be made to the ensuing detailed description taken in conjunction with the accompanying drawings.

BRIEF DESCRIPTION OF THE DRAWINGS

FIG. 12(*b*) is an explanatory drawing that shows a state where a sheet of solidly black-printed (100%) paper is transported into the fixing device.

FIG. 16(*b*) is a plan view showing a blurred image.

DESCRIPTION OF THE EMBODIMENTS

[First Embodiment]

Figure 16B:
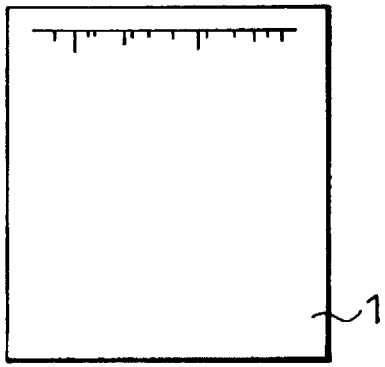
FIG. 16(*a*) is a plan view showing an image without blurredness.
Figure 16A:
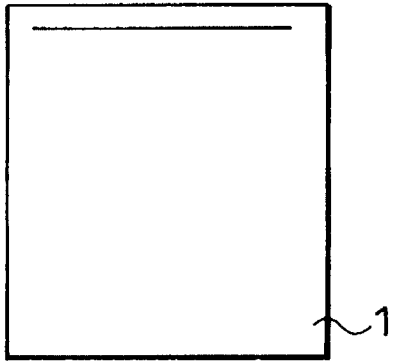

Referring to FIGS. 1 through 12 as well as FIG. 16, the following description will discuss one embodiment of the present invention. Here, the present embodiment deals with an example wherein a fixing device in accordance with the present invention is applied to a laser printer.

Figure 3:
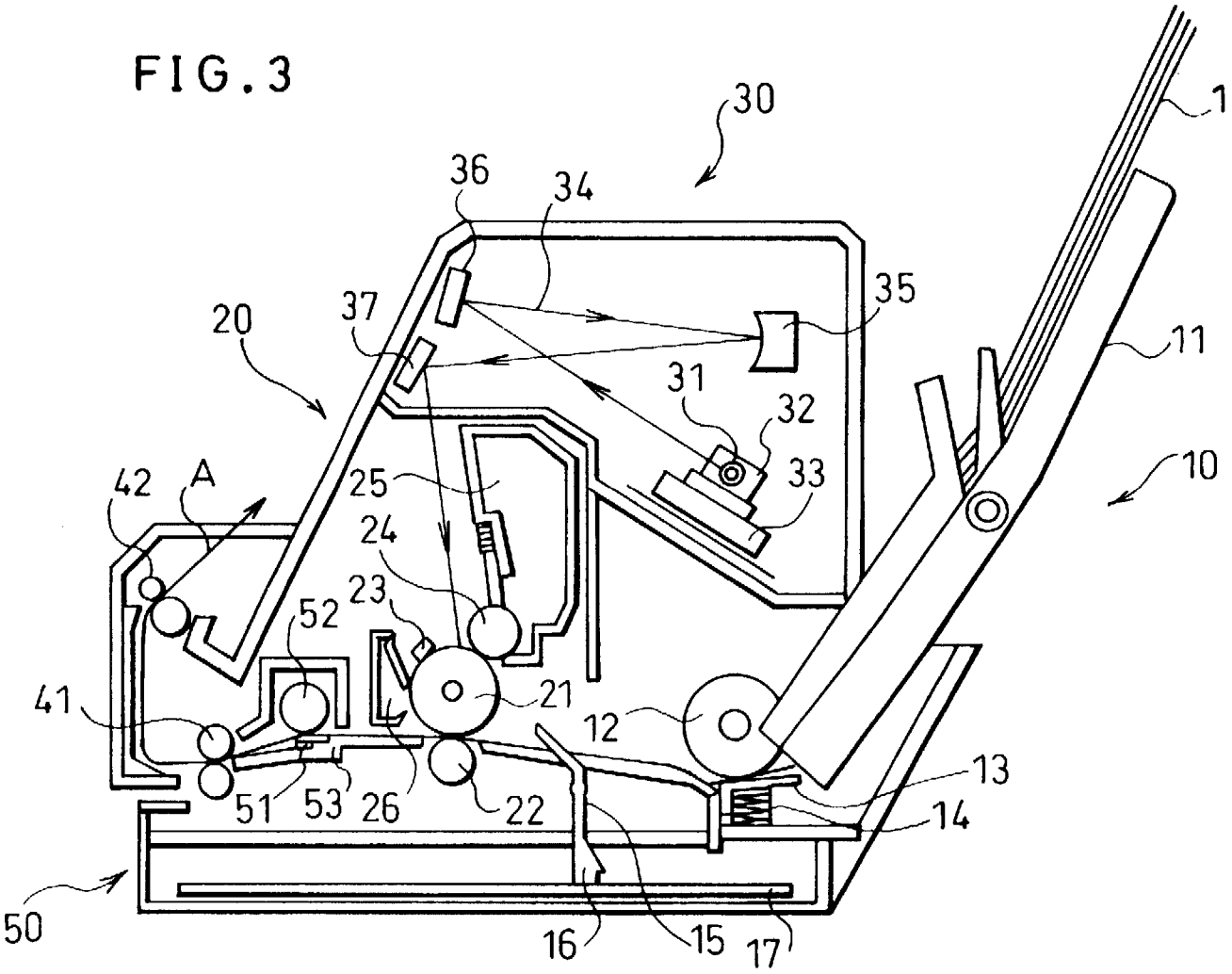
FIG. 3 is a cross-sectional view showing a schematic construction of a laser printer that is provided with the fixing device.

As illustrated in FIG. 3, the laser printer has a paper-feed section 10, an image-forming device 20, a laser scanning section 30, and a fixing device 50 of the present invention. The paper-feed section 10 feeds a sheet of paper 1 (recording material) to the image-forming device 20 that is installed in the printer. The image-forming device 20 transfers a toner image corresponding to an electrostatic latent image that has been formed by the laser scanning section 30, onto a sheet of paper 1 that has been transported. The fixing device 50 fixes the toner on the sheet of paper 1 that has been further transported thereto. Thereafter, the sheet of paper 1 is ejected out of the printer by paper-transport rollers 41 and 42. In other words, the sheet of paper 1 proceeds through a path indicated by a solid line, arrow A, in FIG. 3.

The paper-feed section 10 is constituted of a paper-feed tray 11, a paper-feed roller 12, a paper-separating-use friction plate 13, a pressure spring 14, a paper-detection actuator 15, a paper-detection optical sensor 16, and a control circuit 17.

Upon receipt of a printing instruction from an externally connected host computer (not shown), sheets of paper 1, which have been placed in the paper-feed tray 11, are fed one sheet by one sheet through functions of the paper-feed roller 12, the paper-separating-use friction plate 13 and the pressure spring 14, and successively transported through the inside of the printer. When the fed sheet of paper 1 pushes the paper-detection actuator 15 down, the paper-detection optical sensor 16 releases an electric signal indicating the corresponding information, thereby specifying the start of an image printing operation. The control circuit 17, which has been activated by the action of the paper-detection actuator 15, sends an image signal to a laser-diode light-emitting unit 31 of the laser scanning section 30, thereby controlling the turning on and off of the light-emitting diode.

The laser scanning section 30 is constituted of the laser-diode light-emitting unit 31, a scanning mirror 32, a scanning-mirror motor 33, and reflection mirrors 35, 36 and 37.

The scanning mirror 32 is constantly rotated at a high speed by the scanning-mirror motor 33. In other words, in FIG. 3, a laser light beam 34 carries out scanning in the axial direction of a photoconductor 21, which will be described later. The laser light beam 34, thus released from the laser-diode light-emitting unit 31, is directed onto the photoconductor 21 in the image-forming device 20 through the reflection mirrors 35, 36 and 37. In this case, the laser light beam 34 exposes the photoconductor 21 selectively, in accordance with the information of the turning on and off from the control circuit 17.

The image-forming device 20 is provided with the photoconductor 21, a transferring roller 22, a charging member 23, a developing roller 24, a developing unit 25, and a cleaning unit 26.

The surface of the photoconductor 21, which has been preliminarily charged to a predetermined electric potential by the charging member 23, is exposed by the laser light beam 34 so that the surface charge of the photoconductor 21 is selectively discharged. Thus, an electrostatic latent image is formed on the photoconductor 21. Toner, which is used for developing, is stored in the developing unit 25. The toner, which has electric charge applied thereto by being appropriately stirred inside the developing unit 25, is allowed to adhere to the surface of the developing roller 24. Then, a toner image corresponding to the electrostatic latent image is formed on the photoconductor 21 by the function of an electric field that is exerted between a developing bias voltage applied to the developing roller.24 and the surface electric potential of the photoconductor 21.

Accordingly, the sheet of paper 1, which has been transported from the paper-feed section 10 to the image-forming device 20, is sent in a sandwiched state between the photoconductor 21 and the transferring roller 22. Then; the toner on the photoconductor 21 is electrically attracted and transferred onto the sheet of paper 1 by the function of an electric field that is exerted by a transferring voltage applied to the transferring roller 22. In this case, some of the toner on the photoconductor 21 is transferred onto the sheet of paper 1 by the transferring roller 22, while untransferred toner is recovered by the cleaning unit 26.

Thereafter, the sheet of paper 1 is transported to the fixing device 50. Here, the fixing device 50 will be described in detail later. In the fixing device 50, appropriate temperature and pressure are applied by a pressure member 51 and a fixing roller 52 that is kept at a temperature of 170° C. (both of which will be described later). Then, the toner is melted and fixed onto the sheet of paper 1 to form a stable image. The sheet of paper 1 is transported by the paper-transport rollers 41 and 42, and ejected out of the apparatus.

Figure 4:
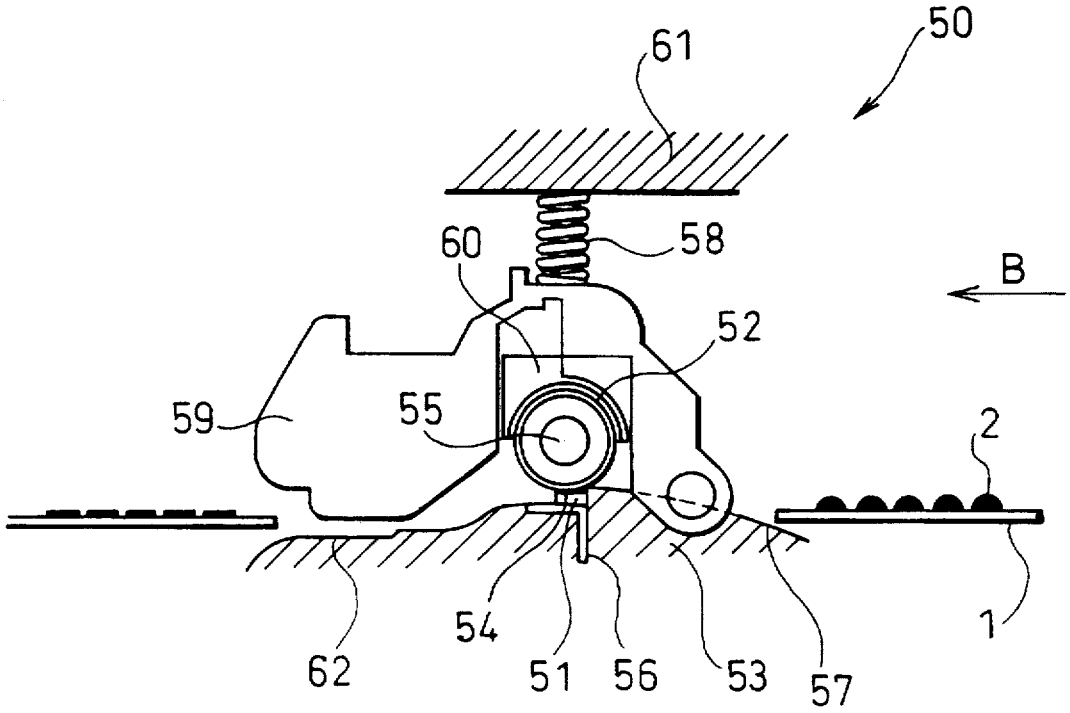
FIG. 4 is an explanatory drawing that shows a schematic construction of the fixing device.

Next, referring to FIG. 4, the following description will discuss the fixing device 50. As illustrated in FIG. 4, the fixing device 50 is provided with the pressure member 51, the fixing roller 52, and a lower frame 53. The fixing roller 52 is constituted of a thin cylindrical body made of aluminum and a coating section with which the circumferential surface of the cylindrical body is coated. The coating section has superior toner-releasing, paper-transporting and heat-resisting properties, and is made of, for example, a synthetic resin material such as silicone rubber. A heater lamp 55 is inserted into the axial core section of the fixing roller 52.

The pressure member 51 is made of silicone sponge rubber with a thickness of 2 mm, and has a hardness of approximately 30 degrees on AmemR C scale. The pressure member 51, which is located between (1) an L-letter-shaped metal plate 56 with a thickness of t1 which is fixed to the lower frame 53 and (2) the fixing roller 52 (that is, on the circumferential surface of the fixing roller 52), is depressed by a pressure-applying spring 58 with an applied pressure of 1200 gf. Here, the pressure member 51 is secured onto the L-letter-shaped metal plate 56 by a heat-resistant double-sided tape. Further, the pressure member 51 is fitted to bosses that stick out from the lower frame 53 in the vicinity of the respective ends of the L-letter-shaped metal plate 56, and thus secured to the lower frame 53, which is a frame constituting the fixing device 50.

Shaft bushes 60 having a semi-circular arc shape are placed at the respective ends of the fixing roller 52 in the axial direction in a manner perpendicular to the axis of the fixing roller 52. Here, the shaft bushes 60 are fitted to a fixing cover 59 made of a heat-resistant resin. The fixing cover 59 is subjected to a pressure applied by an upper frame 61 through the pressure-applying spring 58.

A heat-resistant sheet 54 is inserted between the pressure member 51 and the fixing roller 52. Therefore, since the pressure member 51 is depressed against the fixing roller 52 with the heat-resistant sheet 54 provided therebetween, the fixing roller 52 and the heat-resistant sheet 54 are in contact with each other in a region where the pressure member 51 is depressed against the fixing roller 52. The heat-resistant sheet 54 is secured to the lower frame 53 by a heat-resistant double-sided tape only on the upstream side end, that is, on an end on the side to which a sheet of paper 1 is fed. Since the thermal stress is non-uniform, differing in the region where the pressure member 51 is depressed against the fixing roller 52 and in the other region, the heat-resistant sheet 54 tends to become loose in areas where the thermal stress is non-uniform or in the region where the pressure member 51 is depressed against the fixing roller 52, if the heat-resistant sheet 54 is directly fixed to the pressure member 51 or an end of the heat-resistant sheet 54 on an downstream side of the paper transporting direction is fixed to the lower frame 53.

The heat-resistant sheet 54 with a thickness of 300 μm is formed by coating the surface thereof with a synthetic resin material having superior toner-releasing and heat-resisting properties, or by incorporating such a synthetic resin material inside thereof. The synthetic resin material is, for example, a fluororesin such as, for example, PFA (tetrafluoroethylene-perfluoroalkylvinylether copolymer resin) or PTFE (polytetrafluoroethylene). In the present embodiment, as the heat-resistant sheet 54, a sheet made of PTFE (which normally has a coefficient of friction of 0.04 to 0.1 with respect to aluminum) is used. In the present embodiment, as thermal deformation reducing section, slits **54*a* (cut sections; see FIG. 1) are formed in the transporting direction of paper 1 in the heat-resistant sheet 54, so that deformation due to heat, such as heat applied during fixing or heat caused by friction with the fixing roller 52**, can be reduced.

In the lower frame 53, the upstream side (the side to which the paper 1 is fed) from the fixing roller 52 is set to be higher than the downstream side by a width corresponding to the thicknesses of the pressure member 51 and the heat-resistant sheet 54. The L-letter-shaped metal plate 56 is fitted to the border portion between the upstream side and the downstream side having such a height difference. Further, a prefixing guide 57, which guides the feeding of the sheet of paper 1, is formed on the paper-feeding side of the lower frame 53. A fixing guide 62, which guides the discharging of the sheet of paper 1 on which an image has been fixed, is formed on the paper-discharging side of the lower frame 53.

With this arrangement of the fixing device 50, the sheet of paper 1 to which a prefixed toner image 2 has electrostatically adhered is moved in the paper-transporting direction (in a direction indicated by arrow B in the drawing), and passes through a region where the fixing roller 52 and the heat-resistant sheet 54 are in contact with each other, that is, a nip section, by being guided by the prefixing guide 57. At this time, the prefixed toner image 2, which has electrostatically adhered to the sheet of paper 1, is fixed onto the sheet of paper 1 by heat and pressure applied by the fixing roller 52 so that desired characters or graphics are formed thereon. Thereafter, the sheet of paper 1 passes over the fixing guide 62, and ejected out of the machine. Thus, this arrangement carries out the final fixing stage of an electrophotographic process.

Figure 1:
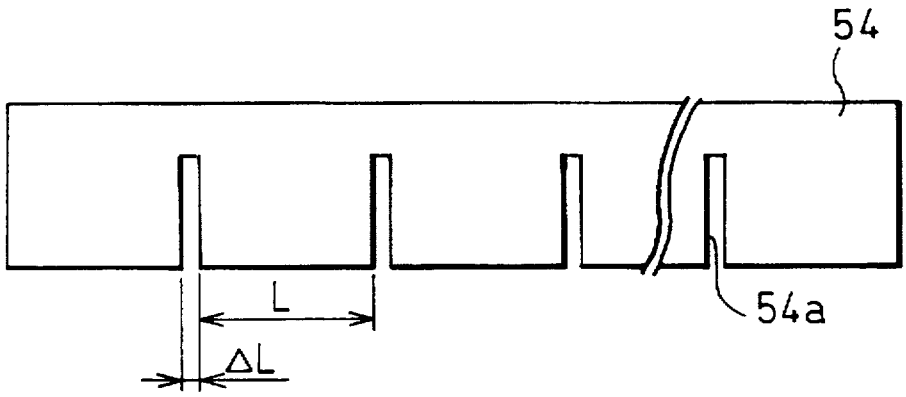
FIG. 1 is a plan view showing one structural example of a heat-resistant sheet that is installed in a fixing device in accordance with the present invention.
Figure 2:
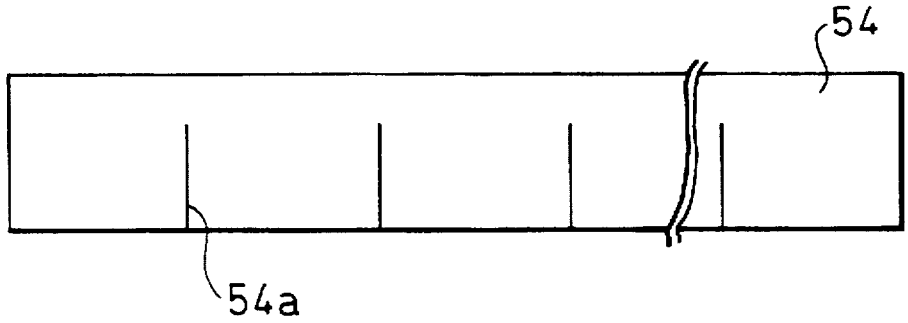
FIG. 2 is a plan view showing a state where the heat-resistant sheet is heated up to a set temperature during a fixing operation.

Referring to FIGS. 1 and 2, the following description will discuss the heat-resistant sheet 54 in detail.

As illustrated in FIG. 1, the heat-resistant sheet 54 is made of the aforementioned synthetic resin material, such as, for example, PFT or PTFE, and has slits **54*a*** as thermal deformation reducing section.

In the present embodiment, each slit is actually a cutout which results on removing a portion between two cuts. In the present embodiment, the heat-resistant sheet 54, which is made of PTFE, is set to have a thickness of 300 μm, a slit width ΔL of 1.2 mm, and a slit interval L of 80 mm. In the present embodiment, the slits **54*a* may be provided in the central part in the transporting direction of the sheets of paper in the heat-resistance sheet 54, but it is preferable that each extends to an edge of the heat-resistant sheet 54 as shown in FIG. 1, for the purposes of reducing fatigue in end portions of the slits 54*a* and more surely absorbing changes in the volume due to swelling or shrinkage. The slit width ΔL and the slit interval L of the heat-resistant sheet 54 are determined by a set temperature of the fixing roller 52 and the inherent coefficient of thermal expansion of the resin of the heat resistant sheet 54 under the temperature. The thickness of the heat-resistant sheet 54 is determined by taking into consideration factors, such as the distance between the heat-resistant sheet 54 and the fixing roller 52 (see FIG. 4) at the nip section, the strength of the pressure member 51 (see FIG. 4), the hardness of the heat-resistant sheet 54, and the abrasion loss due to friction between the heat-resistant sheet 54 and the fixing roller 52, so that long service life of the fixing device 50** can be maintained (in the present embodiment, up to 60000 sheets of paper can be handled).

In a method using a conventional heat-resistant sheet, the heat-resistant sheet expands due to heat from the fixing roller, and causes deflection and distortion on the surface of the heat-resistant sheet, resulting in irregularities in the pressure applied on the fixing roller by the pressure member. Consequently, as illustrated in FIG. 16(*b*), an imperfect fixing, such as blurredness of image, tends to occur, failing to perform a superior fixing operation.

However, the heat-resistant sheet 54 of the present invention starts to expand gradually, as the temperature of the fixing roller 52 increases (wherein the temperature increase at this time (the surface temperature of the fixing roller 52–ambient temperature) is represented by T). When the temperature of the fixing roller 52 further increases, the heat-resistant sheet 54 expands, resulting in deflection on its surface. When the fixing roller 52 reaches the set temperature, the heat-resistant sheet 54 has expanded as shown in FIG. 2 so that the slit width ΔL becomes zero. In other words, the expanded portion, the surface deflection, and the like of the heat-resistant sheet 54 are all absorbed by the slits 54*a*. Therefore, it is possible to keep an optimal nip width (width of a section where the fixing roller 52 and the heat-resistant sheet 54 are in contact with each other in the rotational direction of the fixing roller 52) while maintaining a proper applied pressure of the pressure member 51, without the necessity of having to use a heat-releasing device or increasing the thickness of the heat-resistant sheet 54. Thus, the application of the heat-resistant sheet 54 makes it possible to provide a superior fixing operation without blurredness of image, such as shown in FIG. 16(*a*).

Figure 5:
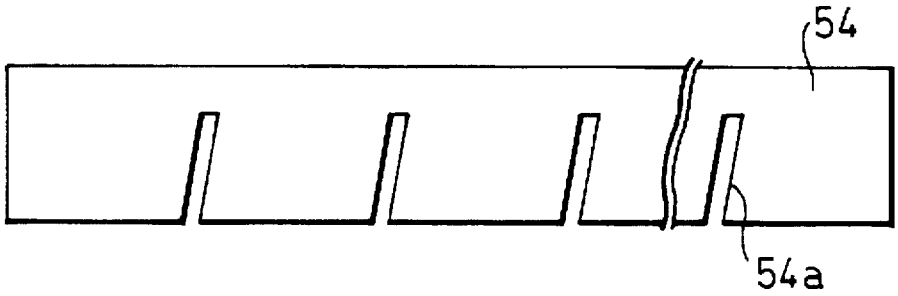
FIG. 5 is a plan view showing another structural example of a heat-resistant sheet.
Figure 6:
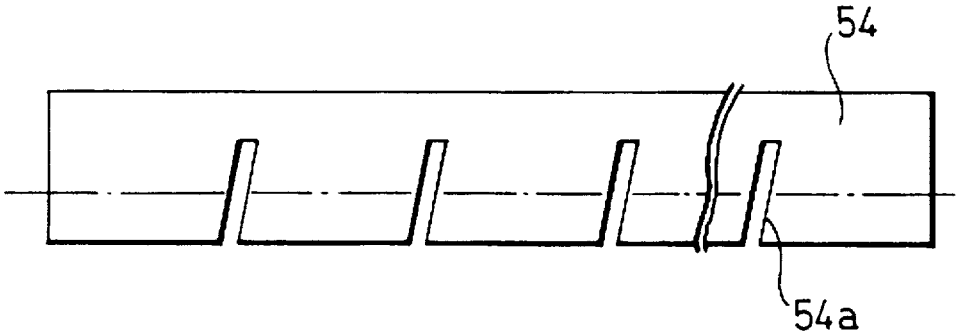
FIG. 6 is a plan view of the heat-resistant sheet of FIG. 5 that indicates a contact portion between the heat-resistant sheet and the fixing roller.
Figure 7:
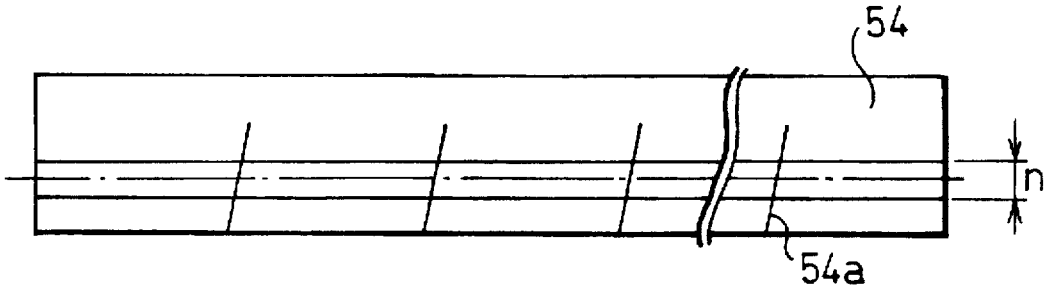
FIG. 7 is a plan view of the heat-resistant sheet of FIG. 5 that indicates the contact portion and a nip between the heat-resistant sheet and the fixing roller.

Referring to FIGS. 5 through 7, the following description will discuss another structural example of the heat-resistant sheet 54.

FIG. 5 is a plan view of a heat-resistant sheet 54 wherein slits 54*a* are designed to tilt with respect to the transporting direction of the paper. In this arrangement of the slits 54*a*, even in the event of an imperfect fixing, for example, due to the fact that the heat-resistant sheet 54 has been used beyond its service life, the imperfect fixing is not so conspicuous, unlike in the event where the slits 54*a* are perpendicular or parallel to the transporting direction of sheets of paper. Therefore, by providing the slits 54*a* so as to tilt with respect to the transporting direction of the paper 1, it is made possible to set factors, such as the slit the width ΔL and the slit interval L of the slits 54*a*, and the temperature of the fixing roller 52, with a relatively wider range, in comparison with the case where the slits 54*a* are perpendicular or parallel to the transporting direction of the paper.

Moreover, FIG. 6 shows a center of a contact portion indicated by an alternate long and short dashes line, which is made when the fixing roller 52 (see FIG. 4) is brought into contact with the heat-resistant sheet 54. Thus, as illustrated in FIG. 5, the fixing roller 52 is designed to contact the heat-resistant sheet 54 so that the contact portion crosses the slits 54*a* at the center portion of the slits 54*a* (the center portion in the lengthwise direction thereof). By doing so, changes in the volume of the heat-resistant sheet 54, such as expansion or shrinkage thereof due to heat, can be surely absorbed by the slits 54*a*. As a result, it is possible to prevent warp and other defects that might occur at the edges of the heat-resistant sheet 54. This eliminates the necessity of having to increase the paper-transporting torque.

Further, FIG. 7 shows a state of the heat-resistant sheet 54 upon application of heat to the fixing roller 52. In this case, the heat is conducted uniformly to the heat-resistant sheet 54 so that the entire surface of the heat-resistant sheet 54 has a uniform temperate. Consequently, it becomes possible for the slits 54*a* to positively absorb the changes in volume of the heat-resistant sheet 54, preventing warp, flexure, and the like of the heat-resistant sheet 54. This arrangement makes it possible to maintain a stable fixing temperature. Besides, with the aforementioned arrangement, it is possible to obtain an optimal nip width n of the nip section having as a center line thereof the line connecting the center portions of the slits 54*a* in the lengthwise direction.

Figure 8:
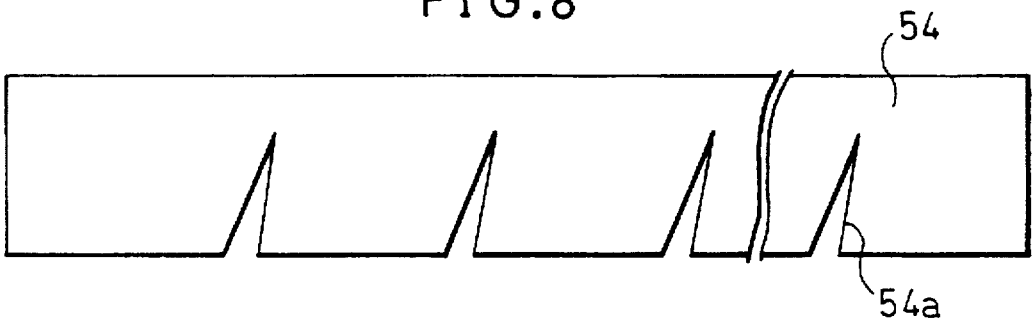
FIG. 8 is a plan view showing a heat-resistant sheet wherein slits, each having a substantially triangular shape, are formed.
Figure 9:
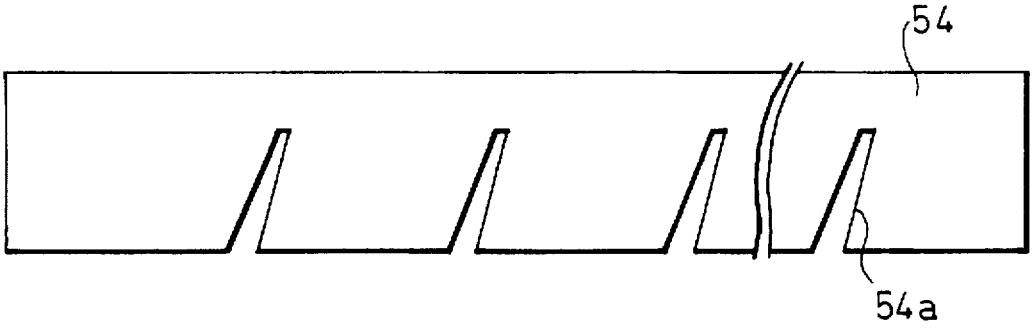
FIG. 9 is a plan view showing a heat-resistant sheet wherein slits, each having a substantially trapezoidal shape, are formed.
Figure 10:
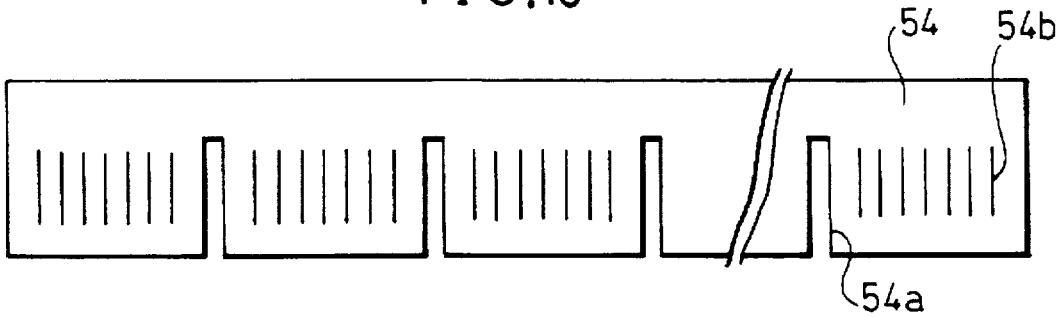
FIG. 10 is a plan view showing a heat-resistant sheet wherein slashes are provided between the slits.

Referring to FIGS. 8 through 10, the following description will discuss still another structural example of the heat-resistant sheet 54.

FIG. 8 shows a plan view of a heat-resistant sheet 54 wherein each of the slits 54*a* has a substantially triangular shape. Further, FIG. 9 shows a plan view of a heat-resistant sheet 54 wherein each of the slits 54*a* has a substantially trapezoidal shape. With these arrangements of the substantially triangular or trapezoidal shape of the slit 54*a*, the slit 54*a* is allowed to positively absorb the expanded portion of the heat-resistant sheet 54 caused by heat. Particularly, the arrangement of the substantially trapezoidal shape of the slit 54*a* also reduces fatigue of the heat-resistant sheet 54 due to expansion or contraction of the heat-resistant sheet 54, fatigue of the cut-out ends of the slits 54*a*, and other fatigues. As a result, it becomes possible to prevent the heat-resistant sheet 54 from being distorted permanently. Furthermore, the application of these heat-resistant sheets 54 provides a stable fixing operation up to the end of its service life. The slit 54*a* may be formed through a single-step processing operation, but it is preferable that they are formed through a two-step processing operation so that processing irregularities occurring to the cutout ends of the slit 54*a* are avoided and fatigue and the like in the cutout ends is reduced.

FIG. 10 shows a plan view of a heat-resistant sheet 54 wherein, as thermal deformation reducing section, a plurality of slashes 54*b* (cut sections) are provided between the adjacent slits 54*a*. Herein, in the present embodiment, the slash, which is a simple cut, should be distinguished from the slit which is a cutout resulting on removing a portion between two cuts.

In the case of the heat-resistant sheet 54 without the slashes 54*b*, when thick sheets of paper, such as envelopes and post cards, are transported, portions of the sheet with which the edges of the paper come into contact tend to be distorted, thereby causing imperfect fixing at the portions. Here, as illustrated in FIG. 10, with the arrangement having the plural slashes 54*b* between the adjacent slits 54*a*, slight flexure and distortion occurring in the heat-resistant sheet 54 are absorbed by the plural slashes 54*b*. Therefore, even in the case when thick sheets of paper are transported, it is possible to prevent flexure and distortion of the heat-resistant sheet 54, and to positively carry out a superior fixing operation.

Moreover, the slashes 54*b* may be provided so that each extends to an edge of the heat-resistant sheet 54, but it is preferable to provide the above-mentioned slashes 54b only in the center portion of the heat-resistant sheet 54 in the recording-material transporting direction. By providing the slashes 54b only in the center portion of the heat-resistant sheet 54 in the recording-material transporting direction, this arrangement sufficiently prevents warp and bent of the heat-resistant sheet 54, and stabilizes the surface temperature of the heat-resistant sheet 54. Therefore, it becomes possible to make the surface temperature of the heat-resistant sheet 54 constant without having variations in the load of the fixing roller 52. Further, it is possible to positively compensate for distortion of the heat-resistant sheet 54 without the necessity of having to increase the paper-transporting torque, and thus to provide a superior fixing operation.

Here, experiments were carried out to examine the fixing property while the slit width ΔL and the slit interval L were varied. Supposing that the coefficient of expansion of PTFE is $1\times10^{-4}$ (1/°C.), the outside air temperature is 20° C., the surface temperature of the fixing roller 52 is 170° C., and the slit interval L is 80 mm, the slit width ΔL under normal temperature is given as 1.2 mm in accordance with the following equation.

$$\Delta L=\alpha\cdot L\cdot T$$

where:

ΔL: slit width (mm) under normal temperature

α: coefficient of expansion (1/°C.) of a material of the heat-resistant sheet 54

L: slit interval (mm) under normal temperature

T: temperature rise (°C.) of the heat-resistant sheet 54 (surface temperature of the fixing roller 52–outside air temperature)

In other words, the heat-resistant sheet 54 whose slit width ΔL is 1.2 mm under normal temperature comes to have a slit width ΔL of zero when heated by the fixing roller 52 whose surface temperature is 170° C.; thus, it becomes possible to provide a superior fixing operation. Table 1 shows the results of the experiments on the fixing property that were carried out while the slit width ΔL and the slit interval L were varied. In this case, the fixing property was evaluated by using residual-toner rate (fixing strength) after rubbing the sheet of paper to which toner adheres.

TABLE 1

| Slit interval L (mm) | 30 | 50 | 70 | 90 | 100 | 110 | 120 | 130 |
|---|---|---|---|---|---|---|---|---|
| Slit width ΔL (mm) | 0.45 | 0.75 | 1.05 | 1.35 | 1.5 | 1.65 | 1.8 | 1.95 |
| Fixing properties | ○ | ○ | ○ | ○ | ○ | ○ | Δ | X |

○: Residual-toner rate of not less than 90%
Δ: Residual-toner rate of not more than 70% but less than 90%
X: Residual-toner rate of less than 70%

The results of Table 1 indicate that, when fixing properties are taken into consideration, the slit interval L becomes optimal when it is set to not more than 110 mm. Even if the slit interval is set to not less than 120 mm, it is theocratically possible for the slits 54a to absorb expansion and flexure of the sheet. However, in an actual operation, since the expansion concentrates on one portion, it is difficult to sufficiently absorb the flexure of the sheet in the case of wide slit intervals.

Therefore, it becomes possible to positively prevent deflection of the heat-resistant sheet 54 by setting the slit interval of the heat-resistant sheet 54 to not more than 110 mm. Further, this arrangement provides a stable fixing operation.

Figure 11:
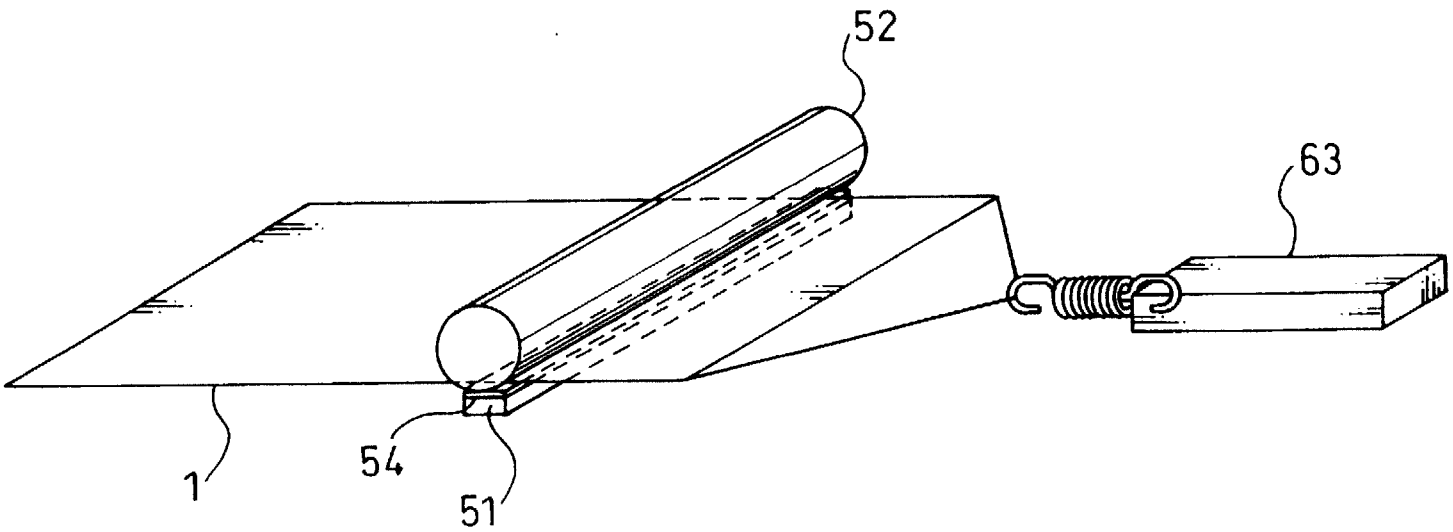
FIG. 11 is a perspective view that shows a state where the paper-transporting force is measured.
Figure 12A:
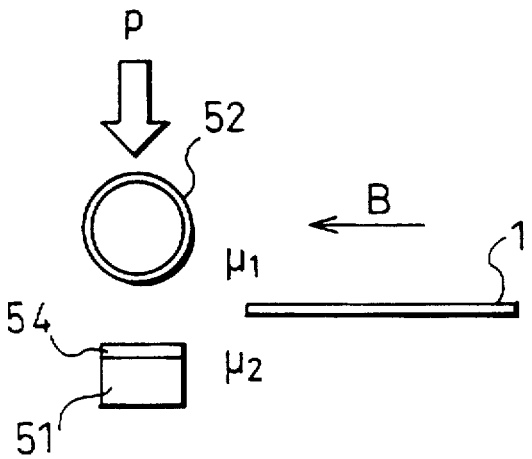
FIG. 12(*a*) is an explanatory drawing that shows a state where a sheet of white paper is transported into the fixing device.
Figure 12B:
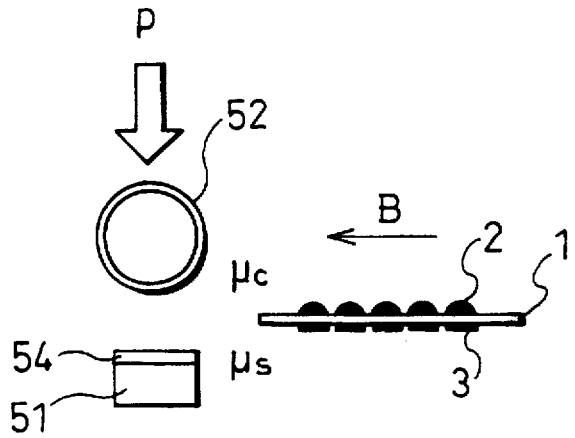
Figure 13:
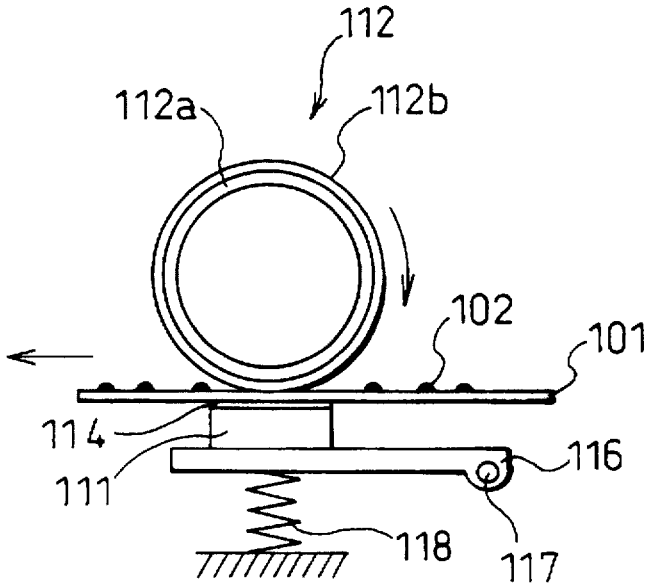
FIG.13 (PRIOR ART)
FIG. 13 is a cross-sectional view showing one structural example of a conventional fixing device using the pressure pad method.
Figure 14:
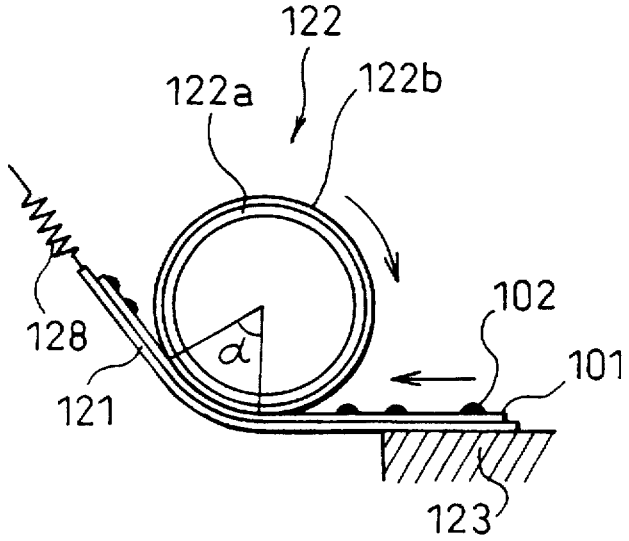
FIG.14 (PRIOR ART)
FIG. 14 is a cross-sectional view showing one structural example of a conventional fixing device using the pressure sheet method.

Referring to FIGS. 11 as well as 12(*a*) and 12(*b*), the following description will discuss the paper-transporting force of the fixing roller 52. The fixing roller 52 is required to have a paper-transporting force in order to transport sheets of paper 1 in the paper-transporting direction. Here, in the present embodiment, in comparison with cases when a sheet of white paper 1 was transported and when a sheet of solidly black-printed (100%) paper 1 was transported, the respective paper-transporting forces were measured. FIG. 11 shows a state wherein the paper-transporting force of the fixing roller 52 was measured. Further, FIG. 12(*a*) shows a state where a sheet of white paper 1 is transported into the fixing device, and FIG. 12(*b*) shows a state where a sheet of solidly black-printed (100%) paper 1 is transported into the fixing device. Additionally, the sheet of solidly black-printed paper 1 on the fixing roller 52 side shows a solidly black-printed state due to a prefixed toner image 2, and that on the heat-resistant sheet 54 side shows a solidly black-printed state due to a fixed image 3 after completion of the fixing operation.

As illustrated in FIG. 11, a sheet of paper 1 (128 g) is first inserted between the fixing roller 52 and the heat-resistant sheet 54. Next, the fixing roller 52 is rotated, and the sheet of paper 1 is transported with the temperature of the fixing roller 52 being set at 140 degrees. In this case, when a spring balance 63, which has been fixed to the sheet of paper 1, pulls the sheet of paper 1, the transport of the sheet of paper 1 is stopped during rotation of the fixing roller 52. Thereafter, when the pulling force of the spring balance 63 is gradually weakened, the transport of the sheet of paper 1 is started again. At the time when the sheet of paper 1 starts to be retransported, the corresponding value on the spring balance 63, that is, a value obtained by adding a transporting force of the fixing roller 52 (a transporting force when the pulling force of the spring balance 63 does not exist) to a resisting force of the sheet of the paper 1, is taken as the paper-transporting force.

Here, in order to transport the sheet of white paper 1, the following equation needs to be satisfied:

$$\mu1(t1\cdot m)\cdot p>\mu2(t2\cdot m)\cdot p+Mp \quad (1)$$

where:

μ1: friction coefficient of the coating member of the fixing roller 52 with respect to the sheet of paper 1 μ2: friction coefficient of the heat-resistant sheet 54 with respect to the sheet of paper 1 p: pressure applied to the sheet of paper 1 (gf)

Mp: paper-transporting force (resisting force of the sheet of paper 1+transporting force of the fixing roller 52)(gf)

In accordance with Formula (1), the relationship μ1>μ2 needs to be satisfied. Here, the friction coefficient μ1 is a coefficient that is dependent on the temperature t1 and material m of the coating member of the fixing roller 52. Similarly, the friction coefficient μ2 is a coefficient that is dependent on the temperature t2 and material m of the heat-resistant sheet 54. In this manner, it becomes possible for the fixing roller 52 to stably transport the sheet of paper 1 by setting the friction coefficient μ1 to become greater than the friction coefficient μ2; thus, it is possible to reduce imperfect transport of sheets of paper.

In the present embodiment, the friction coefficient μ2 is 0.1, the applied pressure p is 1400 gf, and the transporting force Mp is 100 gf. Then, in accordance with Formula (1), the friction coefficient μ1 needs to be set not less than 0.17. Further, supposing that the friction coefficient μ2 is 0.1, the applied pressure p is 1000 gf, and the paper-transporting force Mp is 100 gf, the friction coefficient μ1 needs to be set not less than 0.2 in accordance with Formula (1). Therefore, with respect to the heat-resistant sheet 54, it is preferable to use a material whose friction coefficient μ2 is small, and also to use a great applied pressure p. However, too great an applied pressure p makes the friction torque greater. As a result, the fixing roller 52 tends to easily wear, thereby increasing costs in exchanging fixing rollers 52.

In order to transport the sheet of solidly black-printed (100%) paper 1, on the other hand, the following formulas (2) and (3) need to be satisfied at the same time:

$$\mu C(t1\cdot m)\cdot p>\mu S(t2\cdot m)\cdot p+Mp \quad (2)$$

$$F2\cdot F2'>F3>F1 \quad (3)$$

where:

- μC: friction coefficient of the coating member of the fixing roller 52 with respect to the sheet of paper 1
- μS: friction coefficient of the heat-resistant sheet 54 with respect to the sheet of paper 1
- p: pressure applied to the sheet of paper 1
- Mp: paper-transporting force (resisting force of the sheet of paper 1+transporting force of the fixing roller 52)(gf)
- F1: surface tension between the coating member and the toner (toner-releasing property of the coating member)
- F2: surface tension between the sheet of paper 1 on the fixing roller 52 side and the toner (toner-releasing property of the sheet of paper 1)
- F2': surface tension between the sheet of paper 1 on the heat-resistant sheet 54 side and the toner (toner-releasing property of the sheet of paper 1)
- F3: surface tension between the heat-resistant sheet 54 and the toner (toner-releasing property of the heat-resistant sheet 54)

In the same manner as the transport of the sheet of white paper 1, the friction coefficients μC and μS, the surface tensions F1, F2, F2' and F3 are respectively determined by the temperatures t1 and t2 as well as the material m.

Here, the fluidity of toner varies with temperatures, and at elevated temperatures, the surface tension and friction coefficient with respect to other material become greater at a high temperature. Therefore, in the case when the sheet of solidly black-printed (100%) paper 1 is transported, μS>μ2 holds, thereby making the conditions more severe as compared with the transport of the sheet of white paper 1. Therefore, it is necessary to provide a coating member that has a greater friction coefficient μC and a greater paper-transporting force Mp, as compared with the transport of the sheet of white paper 1.

Next, in the above-mentioned arrangement, paper-transporting tests of sheets of paper 1 were carried out, and the resulting paper-transporting states were evaluated. In this case, double-sided sheets of solid black paper, which have a black-toner density of 1.4, were used as the sheets of paper 1. Additionally, with respect to the sheets of solid black paper, the sheet of solid black paper on the fixing roller 52 side shows a solid black state due to a prefixed toner image 2, and that on the heat-resistant sheet 54 side shows a solid black state due to a fixed image 3 after completion of the fixing operation. The fixing roller 52 is combinedly provided with properties, such as a toner-releasing property, a heat-resistant property and a paper-transporting property. In the present embodiment, the evaluations were carried out by using paper-transporting forces Mp of five types, that is, 170 gf, 250 gf, 300 gf, 500 gf, and 1500 gf. Moreover, the transport of sheets of paper 1 were carried out by using a multi-printing process with a paper-transport interval of 3 seconds and a single-multi-printing process with a paper-transport interval of 60 seconds. Here, in the multi-printing process, the fixing roller 52 was adjusted to have a temperature of 140° C. during 3 seconds of a non-paper-transporting period of paper 1. In contrast, in the single-multi-printing process, the fixing roller 52 was not adjusted in its temperature during 60 seconds of a non-paper-transporting period of paper 1. Moreover, the paper-transporting speed was 25 mm/sec in the respective cases. Table 2 shows the results of the tests.

TABLE 2

| Paper- | Paper-transporting property of samples whose rear-surface is 100% printed | | |
|---|---|---|---|
| Transport Force (gf) | Multi-Printing Process | Single-Multi-Printing Process | General Judgement |
| 170 | X | X | C |
| 250 | Δ | X | B |
| 300 | ○ | ○ | A |
| 500 | ○ | ○ | A |
| 1500 | ○ | ○ | A |

Paper-Transporting property:
○: Perfect
Δ: Occasionally Imperfect
X: Imperfect
General Judgement:
A: Perfect
B: Occasionally Imperfect
C: Imperfect The results shows that when the paper-transporting as set to 300 gf, 500 gf, and 1500 gf, the paper-transporting property was excellent both in the multi-printing process and the single-multi-printing process. Further the fixing roller 52 was rotated without load with its roller surface temperature kept at 140° C. for the time corresponding to the passage of 60000 sheets of paper that is the usable period of the fixing device 50 (in a state where the fixing roller 52 was kept in contact with the heat-resistant sheet 54). More specifically, in the laser printer of the present embodiment that printouts four sheets per minute, the fixing roller 52 was rotated with its roller surface temperature kept at 140° C., for 1500 minutes (250 hours). As a result, the paper-transporting force was lowered by 10%. The reasons are given as follows: One reason is friction between the fixing roller 52 and the heat-resistant sheet 54 (made of PTFE in the present embodiment). The other is that PTFE is shifted from the heat-resistant sheet 54 to the coating layer side of the fixing roller 52.

Therefore, with respect to the paper-transporting force Mp required for the fixing roller 52, it is preferable to provide not less than 300 gf. It is possible to carry out a stable paper-transporting operation without causing any imperfect paper transport, irrespective of any type of paper 1, by determining the lower limit of the paper-transporting force Mp in this manner.

In this case, in order to obtain a greater paper-transporting force Mp, the paper-transporting torque should be increased. Besides, a greater paper-transporting force Mp causes a greater friction between the fixing roller 52 and the heat-resistant sheet 54, which may lead to fatigue of the fixing roller 52 and the heat-resistant sheet 54. Therefore, by setting the paper-transporting force Mp at a value in the vicinity of the lower limit, it is possible to obtain a fixing roller 52 that has a superior toner-separating property. Consequently, taking into consideration the balance among the stability of paper transportation, the paper-transporting torque, and the friction between the fixing roller 52 and the heat-resistant sheet 54, the optimum value of the paper-transporting force Mp is 350 gf.

Note that the number and shape of the slits 54*a* and the slashes 54*b*, the tilt with respect to the paper-transporting direction, and the like may be appropriately set depending on the size of the heat-resistant sheet 54 and the conditions wherein it is used, and they are not specifically limited.

[Second Embodiment]

The following description will discuss another embodiment of the present invention, while referring to FIGS. 17 through 21. A basic arrangement of the present embodiment is the same as that of the first embodiment, and hence the following description will explain parts different from those of the first embodiment. The members having the same structure (function) as those in the first embodiment will be designated by the same reference numerals and their description will be omitted.

In the first embodiment, by providing the slits 54*a* as the thermal deformation reducing sections, deformation of the heat-resistant sheet 54 due to heat when heating the fixing roller 52 is reduced. In the first embodiment, when the fixing roller 52 is heated substantially uniformly in the lengthwise direction, that is, in the axial direction of the fixing roller 52, the heat-resistant sheet 54 expands, thereby causing the slit width ΔLof the slits provided in the heat-resistant sheet 54 to become zero. Thus, the flexure or distortion (wave, warp, etc.) of the heat-resistant sheet 54 is reduced, resulting in that fixation of toner is hardly influenced by heat deformation of the heat-resistant sheet 54. Consequently, a predetermined nip width n of the heat-resistant sheet 54 pressed against the fixing roller 52 can be maintained, thereby allowing the fixation to be desirably carried out.

However, depending on the material of the heat-resistant sheet 54 or the manufacturing method thereof, even though temperature distribution in the axial direction of the fixing roller 52 is uniform, sometimes expansion due to heat is not constant, whereby the slit width ΔL of the slits 54*a* does not become zero. Or, sometimes the heat-resistant sheet 54 is partially waved or warped, whereby the heat-resistant sheet 54 is not depressed against the fixing roller 52 with a uniform nip width n.

Furthermore, in the case where the slits 54*a* are provided in the same manner as in the first embodiment, the optimal slit width ΔL and the optimal slit interval L may occasionally vary depending on manufacturing conditions of a material (manufacturing lot (manufacturing number) of material). Therefore, depending on a material, sometimes the slit width ΔL does not become completely zero during fixing (at a high temperature), even though the slits 54*a* are provided in the heat-resistant sheet 54. In these cases, irregularities in fixing may occur at positions corresponding to the slits 54*a*.

Besides, it is difficult to obtain a uniform temperature distribution in a whole range in the axial direction of the fixing roller 52, and a difference in temperatures occurs more or less in the axial direction of the fixing roller 52. In some cases, due to this temperature difference, the heat-resistant sheet 54 is partially waved or warped.

These defects possibly occur in the case where the coefficient of thermal expansion of the heat-resistant sheet 54 is unstable, or the heat-resistant sheet 54 is subjected to non-uniform thermal stress. The following description will explain the defects in more detail, while mentioning a manufacturing method of the heat-resistant sheet 54.

One of the manufacturing methods of the heat-resistant sheet 54 will be explained below, while referring to FIGS. 19 through 21. The heat-resistant sheet 54 is made of a synthetic resin material which is a mixture of a synthetic resin material (A) with a high heat resistance as a primary component and a synthetic resin material (B) which has superior toner releasing property and heat resisting property. Polyimide (PI), for example, can be used as the synthetic resin material (A), while a fluorocarbon resin such as PFA, RTFE, or the like can be used as the synthetic resin material (B).

The heat-resistant sheet 54 is, for example, formed as a roll-like material sheet 71, which is made by molding the synthetic resin material described above in a cylindrical form and peeling it. By die-cutting the material sheet 71, heat-resistant sheets 54 having desired shape and size can be obtained.

However, the material sheet 71, curling in the roll-like form because having been peeled off from the cylinder-shaped material, cannot be used as the heat-resistant sheet 54 if it remains curling.

Therefore, in order to making a flat master sheet from the curling material sheet 71, the material sheet 71 is rolled by heating rollers, for example, with a uniform tension in a lengthwise direction thereof (in a direction indicated by an arrow C in the drawing). Thereafter, a heat treatment (for example, at or over 300° C. for 5 hours) is applied to the material sheet 71 thus rolled, so that residual stress therein is removed.

The material sheet 71 thus made flat (master sheet) is die-cut with the use of a mold or the like so that heat-resistant sheets 54 with predetermined shape and size can be obtained. Thus, the heat-resistant sheet 54 is formed.

In the case of the heat-resistant sheets 54 formed in the above-described manner, the coefficient of thermal expansion is unstable. Therefore, in the case where the heat-resistant sheet 54 thus formed is used, the above-described defects may occur.

Figure 19:
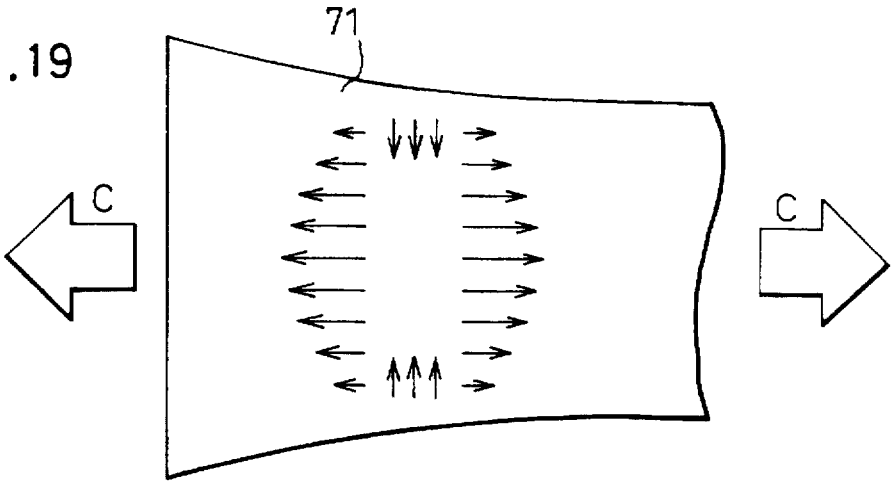
FIG. 19 is an explanatory view showing stress remaining in a heat-resistant sheet in the manufacturing process of the heat-resistant sheet to be provided in the fixing device of the present invention.

In addition, as illustrated in FIG. 19, in the manufacturing process of the heat-resistant sheet 54, a tension in the lengthwise direction (direction indicated by the arrow C) of the material sheet 71 is applied thereto, whereby a residual stress in an outward direction is caused in edge parts and a center part in the lengthwise direction of the material sheet 71. On the other hand, in edge parts in a direction perpendicular to the lengthwise direction, a residual stress in an inward direction is caused. The residual stress cannot be completely removed even though a heat treatment for removing the residual stress is applied.

Therefore, in the case where the heat-resistant sheet 54 is made of a part of the material sheet 71 in which the residual stress remains, the heat resistant sheet 54 deforms in a direction such that the residual stress is reduced, when heated for fixation or when pressure is applied for fixation. To be more specific, in the direction in which the material sheet 71 was rolled, the heat-resistant sheet 54 has a residual stress of shrinkage upon heat application, whereas in an orthogonal direction to the rolling direction, it has a residual stress of stretch upon heat application. Therefore, in the case where the heat-resistant sheet 54 is made of a part in which the residual stress remains, when the residual stress is reduced upon heat application, the heat-resistant sheet 54 remarkably deforms, thereby causing irregularities in fixing.

Figure 20:
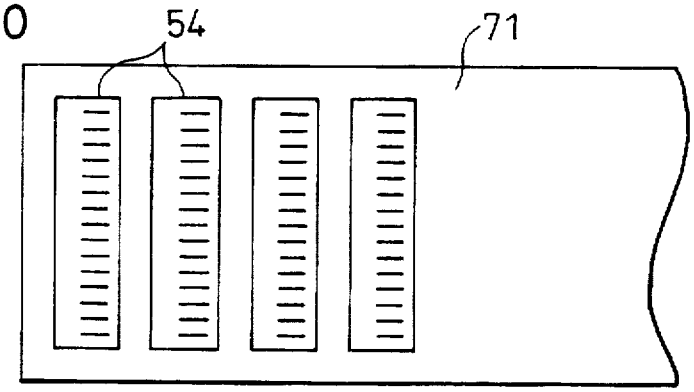
FIG. 20 is a plan view showing how a heat-resistant sheet is cut out from a material sheet so that the lengthwise direction of the heat-resistant sheet is perpendicular to the lengthwise direction of the material sheet.

Particularly in the case where, as illustrated in FIG. 20, the heat-resistant sheet 54 is die-cut so that the lengthwise direction of the heat-resistant sheet 54 is perpendicular to the lengthwise direction of the material sheet 71, the both edge parts in the lengthwise direction of the heat-resistant sheet 54 deforms due to, apart from thermal expansion, stretching in the lengthwise direction of the heat-resistant sheet 54 in which the residual stress is reduced, upon heat and pressure application by the fixing roller 52 for fixing. As a result, if the heat-resistant sheet once heated for fixing is cooled down to normal temperature during a standby period till the next sheet transportation, the slits 54*a* in lengthwise-direction end portions of the heat-resistant sheet 54 tend to have greater slit widths ΔL than those before heating, due to the deformation of the heat-resistant sheet 54 in the lengthwise direction thereof, caused by a residual stress being reduced upon heating. Therefore, in the next fixing action, the thermal expansion does not cause the slits 54*a* in lengthwise-direction end portions of the heat-resistant sheet 54 to have a width of 0 mm. On the other hand, in the center part of the heat-resistant sheet 54, deformation in the lengthwise direction due to the residual stress reduced upon heating does not occur. Therefore, the slit width ΔL of the slits 54*a* in the center part of the heat-resistant sheet 54 does not change when cooled down to normal temperature, compared with before heat application. With respect to the heat-resistant sheet 54 in the case where the slits and slashes are provided therein, this difference in expansion causes irregular changes of the slit width ΔL and the slash interval. In other words, the slit width ΔL and the slash interval of the heat-resistant sheet 54 which was die-cut at normal temperature differently change in the central part and the edge parts of the heat-resistant sheet 54 due to fixing heat and fixing pressure. As a result, the expansion due to the heat for fixing cannot be sufficiently absorbed, thereby partially waving, ribbing, or warping the heat-resistant sheet 54. Accordingly, the heat-resistant sheet 54 does not stably contact the fixing roller 52, thereby having an unstable nip width, which causes irregularities in fixing.

To solve these defects, there is a method whereby a mother sheet (material sheet 71) is prepared so as to have a sufficient width with respect to the size of the heat-resistant sheet 54 as a finished product so that edge parts are not used. For example, to form a heat-resistant sheet 54 which is 231 mm long in the lengthwise direction, a sheet with a width of 300 mm should be prepared. To do so, the synthetic resin material described above should be molded in a cylindrical form having a height of 300 mm. However, practically it is rather difficult to obtain such a molding. Besides, since the edge parts each having a width of 35 mm, therefore 70 mm in total, are not used but wasted, this raises production costs of the heat-resistant sheet 54.

Figure 21:
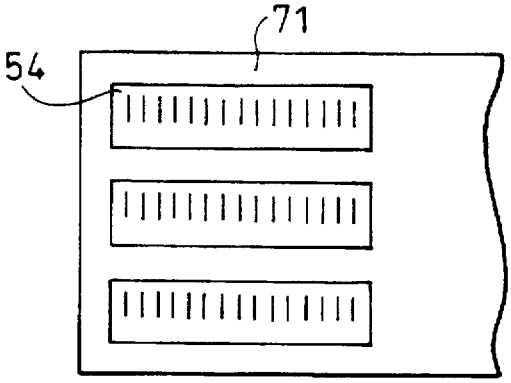
FIG. 21 is a plan view showing how the heat-resistant sheet is cut out from the material sheet so that the lengthwise direction of the heat-resistant sheet is parallel to the lengthwise direction of the material sheet.

Then, there is another method for manufacturing the heat-resistant sheet 54, whereby the heat-resistant sheet 54 is die-cut from the material sheet 71 so that the lengthwise direction of the heat-resistant sheet 54 is parallel to the lengthwise direction (rolling direction) of the material sheet 71, as illustrated in FIG. 21.

The heat-resistant sheet 54 thus produced shrinks due to heat and pressure during fixing so that the residual stress is reduced. Therefore, the slit widths ΔL of the slits 54*a*, provided not parallel (for example, orthogonal) to the rolling direction of the material sheet 71 do not increase. Besides, the shrinkage of the heat-resistant sheet 54 is uniform in the lengthwise direction of the heat-resistant sheet 54. Therefore, even though the slits 54*a* and slashes 54*b* change in dimension due to the shrinkage of the heat-resistant sheet 54, respective changes thereof are uniform.

Moreover, even though the cylindrical molding obtained by molding the aforementioned synthetic resin is 150 mm high, the heat-resistant sheet 54 having a length exceeding 240 mm can be obtained. By doing so, the production costs of the heat-resistant sheet 54 constituting the fixing device can be cut off.

In the case where a fixing device is made using the heat-resistant sheet 54 formed in the foregoing manner and 500 to 1,000 sheets of paper are continuously printed with the use of the fixing device, the heat-resistant sheet 54 is subject to heat of a high temperature which is emitted by the fixing roller 52. However, the temperature is not constant. Besides, when a sheet of paper 1 is transported between the heat-resistant sheet 54 and the fixing roller 52, the heat-resistant sheet 54 receives heat through the sheet of paper 1 from the fixing roller 52, whereas it receives heat directly from the fixing roller 52 when no paper is transported therebetween (that is, after the sheet of paper 1 passed through therebetween and before a next sheet of paper 1 arrives). In this case, pressure of the fixing roller 52 is directly applied the section which is subject to pressure, that is, the nip section in which the fixing roller 52 and the heat-resistant sheet 54 come into contact. But, the heat of the fixing roller 52 is hardly transmitted to the part other than the nip section. Therefore, the thermal stress which is not uniformly applied causes the heat-resistant sheet 54 to warp, distort, or wave.

Furthermore, as described above, the upstream-side edge portion of the heat-resistant sheet 54 is secured to the lower frame 53 by adhesive substance such as a heat-resistant double-sided tape. Therefore, warp, distortion, or wave hardly occurs in the portion of the heat-resistant sheet 54 on the upstream side. However, a portion of the heat-resistant sheet 54 on the downstream side is easily subjected to non-uniform thermal stress, and hence the portion is likely waved. Therefore, in the case where some parts are thus waved and the wave extends to the nip section, the fixing pressure becomes non-uniform, thereby causing irregularity in fixing.

Figure 17:
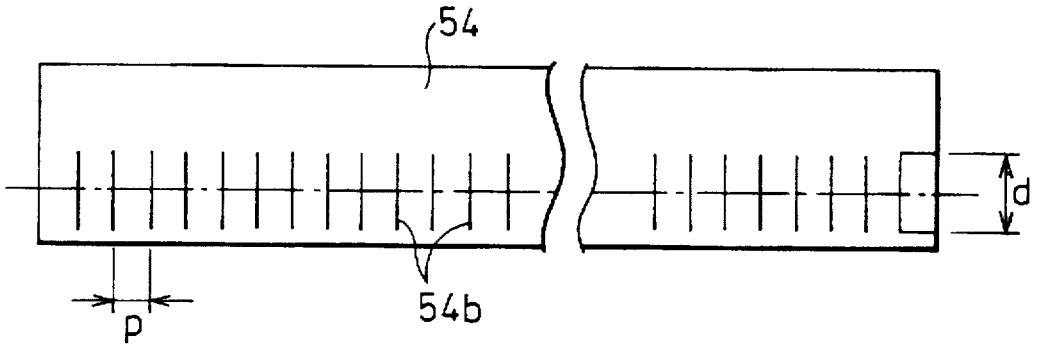
FIG. 17 is a plan view showing still another structural example of a heat-resistant sheet.

Therefore, in the present embodiment, instead of the slits 54*a*, slashes 54*b* (cut sections) are provided as thermal deformation reducing sections in the heat-resistant sheet 54 as illustrated in FIG. 17, so that heat deformation of the heat-resistant sheet 54 is reduced and desirable fixing is carried out, even in the case where the coefficient of thermal expansion is changeable, or in the case where non-uniform thermal stress is applied to the heat-resistant sheet 54. For example, a heat-resistant sheet 54 which is 231 mm long, 14 mm wide, and 0.3 mm thick, is formed, and slashes 54*b* having a length d of 8 mm are provided at intervals (slash intervals) P of 1.41 mm in a direction perpendicular to the lengthwise direction of the heat-resistant sheet 54, that is, in a direction parallel to the paper-transporting direction.

Figure 18:
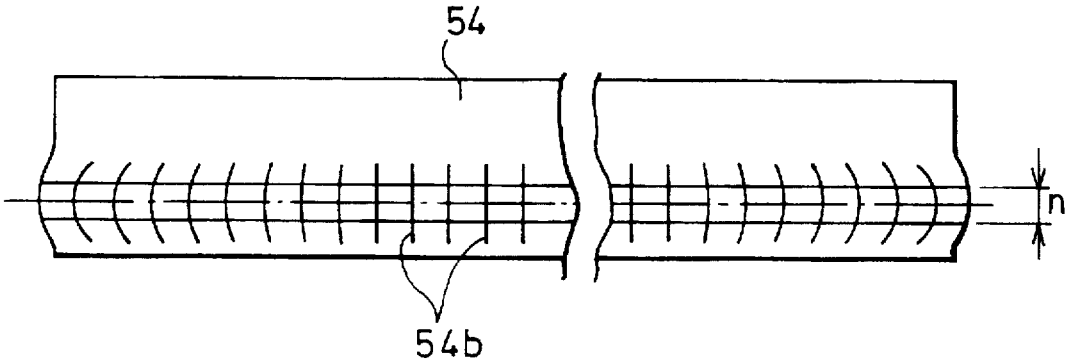
FIG. 18 is a plan view showing a state where the heat-resistant sheet of FIG. 17 is heated up to a set temperature during a fixing operation.

Thus, in the case where the heat-resistant sheet 54 in which the slashes 54*b* are provided at predetermined intervals P is used, when the temperature is high, that is, when fixing is carried out, the heat-resistant sheet 54 expands only in the lengthwise direction (that is, in the rotation axis direction of the fixing roller 52) around the slashes 54*b* and does not expand in the direction perpendicular to the lengthwise direction, as illustrated in FIG. 18. Therefore, it does not occur that the heat-resistant sheet 54 is partly waved or warped in the transporting direction of paper 1, while no change occurs in the nip width n (in the first embodiment, the nip width n is 1.5 mm).

In other words, with the use of the heat-resistant sheet 54 wherein the slashes 54*b* are provided at predetermined intervals P, the nip width does not change and an optimal nip width n can be obtained even when the fixing roller 52 is heated thereby becoming ready for fixing. Therefore, fixing is always stably carried out.

The following description will depict a result of an examination on how the slashes 54*b* should be formed. Table 3 shows results of printing operations which were carried out while the interval P at which the slashes 54*b* were provided in the heat-resistant sheet 54 was varied. Note that conditions other than the interval P are as described above. Namely, the slashes 54b having a length d of 8 mm each are provided in the heat-resistant sheet 54 which is 231 mm long, 14 mm wide, and 0.3 mm thick.

TABLE 3

| INTERVAL (mm) | RESULT OF PRINTING | DURING PRINTING |
|---|---|---|
| 0.5 | Fixing irregularities occur where processing irregularities occur. | Processing irregularities occur. |
| 1.0 | Good. | |
| 3.0 | Fixing irregularities occur at 3-mm intervals. | |

The following was found from Table 3. Namely, in the case where the slashes 54b were provided at short intervals P, the effect for reducing the thermal expansion was enhanced, whereas processing irregularities likely occurred. Therefore, fixing irregularities sometimes occurred where the processing irregularities had occurred. Note that usually the processing irregularities are caused at a manufacturing stage where the slashes 54b are formed. The irregularities are deformed shapes or irregular intervals of some slashes 54b which result from influences of neighboring slashes 54b, and such processing irregularities vary with the thickness of the heat-resistant sheet 54. On the other hand, in the case where the slashes 54b were provided at long intervals P, the slashes 54b were incapable of reducing the thermal expansion, thereby causing fixing irregularities to occur at intervals corresponding to the intervals P.

Then, the interval P of the slashes 54b was further varied, and processibility and fixing characteristics were evaluated. As a result, the following was found. Namely, in the case where the slashes 54b were formed in the high-resistant sheet 54 with a thickness of 0.3 mm at intervals P each of which was less than two times the thickness of the heat-resistant sheet, it was difficult to uniformly form the slashes 54b. Also in the case where each interval P exceeded ten times the thickness of the heat-resistant sheet 54, gloss irregularities occurred in accordance with the interval P, resulting in that dissatisfactory pictures were obtained.

As has been described, it is preferable to set the interval P of the slashes 54b depending on the thickness of the heat-resistant sheet 54. It is more preferable to set the interval not less than twice and not more than ten times the thickness of the heat-resistant sheet 54. In the case where the slashes 54b are provided at shorter intervals P, the fixing operation is hardly affected by physical properties of the heat-resistant sheet 54 including the thermal expansion coefficient and expansion direction, and wave, ribbing, and warp due to the thermal expansion of the heat-resistant sheet 54 occurring when being heated by the fixing roller 52 are suppressed. Thus, the fixing operations are stably carried out with a desired nip width maintained. On the other hand, in the case where the interval P is too short, processing irregularities occur to the slashes 54b, thereby causing fixing irregularities to occur. Furthermore, it becomes difficult to maintain the sheet-like shape of the heat-resistant sheet 54. Therefore, by setting the interval P not less than twice the thickness of the heat-resistant sheet 54, the processing irregularities are eliminated, while stable fixing operations are carried out. Moreover, by setting the interval P not more than ten times the thickness of the heat-resistant sheet 54, the fixing irregularities such as gloss irregularities are eliminated. How the slashes 54b are provided is dependent on the interval P of the slashes 54b, but in the case where the slashes 54b are provided at relatively narrow intervals P, it is preferable that the slashes 54b are provided only in the paper-transporting-direction center portion of the heat-resistant sheet 54, since such arrangement allows the heat-resistant sheet 54 to maintain its shape as a sheet and sufficiently prevents warp shape as a sheet and sufficiently prevents warp and bent thereof.

Table 4 below shows results of examination on the length d of the slash 54b, that is, the length of the slash 54b in the paper transporting direction. The other conditions except the length d are as described above.

TABLE 4

| SLASH LENGTH d (mm) | PRINTING RESULT | RATIO OF SLASH LENGTH TO NIP WIDTH |
|---|---|---|
| 2 | X | about 1.3 times |
| 3 | ○ | about 2 times |
| 8 | ○ | about 5.3 times |

○: GOOD (fixing irregularities were not seen)
X: BAD (fixing irregularities were seen)

The following is clear from Table 4. Namely, in the case where the slash 54b are short, influences by thermal expansion and the like are not sufficiently reduced, thereby resulting in that fixing irregularities occur sometimes. The longer the length d of the slashes 54b is, the more hardly the slashes 54b are affected by physical properties of the heat-resistant sheet 54 including the thermal expansion coefficient and the expansion direction. Therefore, in the case where the slash 54b is sufficiently long, the thermal expansion is sufficiently absorbed, and defects caused by the wave or the like of the heat-resistant sheet 54 or the like are prevented. As a result, stable fixing operations are carried out.

Furthermore, correlations between the length d of the slash 54b and a contact width (nip width n (about 1.5 mm)) between the heat-resistant sheet 54 and the fixing roller 52 were examined, and a good result was obtained when the length d of the slash 54b was not less than twice as great as the nip width, as shown in Table 4 above. Herein, assume that the positions of the fixing roller 52 and the heat-resistant sheet 54 were arranged so as to come into contact at the center of each slash 54b.

Note that, in Table 4 , since the width (length in the paper transporting direction) of the heat-resistant sheet 54 was set to 14 mm, the slash 54b by no means had a length d greater than 14 mm. Besides, since an edge portion of the heat-resistant sheet 54 was adhered to the lower frame 53, it was required to set the length d of the slash 54b at least not more than 10 mm. Therefore, the length d of the slash 54 may be set so long as to allow the heat-resistant sheet 54 to maintain its shape as sheet, depending on the width of the heat-resistant sheet 54.

Thus, in the case where thermal expansion coefficient of the heat-resistant sheet 54 is not stable, or in the case where non-uniform thermal stress is applied to the heat-resistant sheet 54, wave or other defects of the heat-resistant sheet 54 due to the thermal expansion or the like can be prevented by providing the slashes 54b at desired intervals P without providing slits 54a. As a result, stable fixing operations can be carried out. In this case, it is preferable that the interval P is set to not less than twice and not more than ten times the thickness of the heat-resistant sheet 54. Besides, it is preferable that the length d of the slash 54b is set not less than twice the nip width.

Furthermore, the description of the present embodiment exemplifies a case where the slashes 54b are provided in parallel to the paper transporting direction, but they may be provided more or less obliquely with respect to the paper transporting direction, like the slits 54a in the first embodiment.

Moreover, the requirements regarding the length d and the interval P of the slash 54b may be applicable to the slash 54b (see FIG. 10) in the first embodiment. By setting the length and interval of the slash 54b as the length d and interval P of the slash 54b are set, further preferable results will be obtained regarding the first embodiment.

Figure 15:
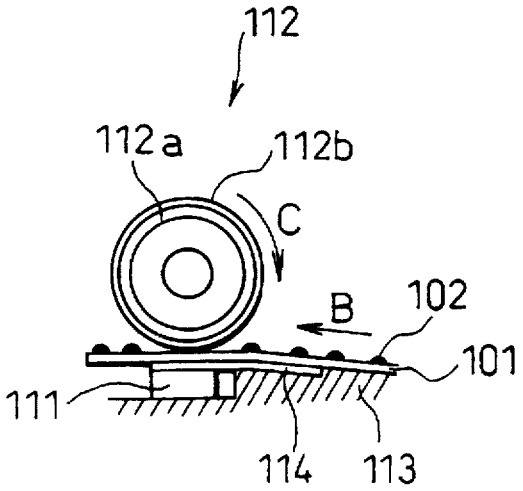
FIG. 15 is a cross-sectional view showing one structural example of a fixing device using the pressure pad method in which a heat-resistant sheet is installed.

Note that there are other methods for reducing thermal deformation of a heat-resistant sheet, for example, a method whereby a heat-resistant sheet 114 is provided between a fixing roller 112 and a pressure member 111, and a heat radiation member made of aluminum foil, copper foil, or the like, is provided outside the heat-resistant sheet 114, so as to be separated from the heat-resistant sheet 114, as illustrated in FIG. 15.

The following description will explain a fixing device shown in FIG. 15. The fixing roller 112 is constituted of a thin cylindrical roller 112a made of aluminum and a coating layer 112b with which the circumferential surface of the cylindrical roller 112a is coated.. The coating layer 112b is made of, for example, a heat-resistant rubber having superior toner-releasing, paper-transporting and heat-resisting properties, such as silicone rubber which has a great friction coefficient. Under the fixing roller 112, a pressure member 111 is provided.

A heat-resistant sheet 114 is inserted between the pressure member 111 and the fixing roller 112. The heat-resistant sheet 114 is secured to a lower frame 113 by a heat-resistant double-sided tape. The heat-resistant sheet 114 is formed by coating a surface of a base (100 μm thick) made of glass fiber with a synthetic resin material having superior toner-releasing and heat-resisting properties, or by incorporating such a synthetic resin material inside thereof. The synthetic resin material is, for example, a fluororesin such as, for example, PFA (tetrafluoroethylene-perfluoroalkylvinylether copolymer resin) or PTFE (polytetrafluoroethylene). Paper 101 having thereon a toner image 102 which are not yet fixed is transported to between the fixing roller 112 and the heat-resistant sheet 114, and a fixing operation is carried out. Furthermore, between the heat-resistant sheet 114 and the pressure member ill, a metal foil made of aluminum or the like which is adhered to the lower frame 113 is inserted.

With the above-described arrangement shown in FIG. 15, wherein the metal foil is inserted between the heat-resistant sheet 114 and the pressure member 111, heat from the fixing roller 112, heat caused by friction with the fixing roller 112, and the like, are not accumulated in the heat-resistant sheet 114 but transmitted to the metal foil. As a result, temperature of the heat-resistant sheet 114 is lowered, thereby resulting in that thermal deformation of the heat-resistant sheet 114 is reduced.

In this case, a heat radiating member such as the metal foil may be provided separate from the heat-resistant sheet 114. Alternatively, the metal foil may be laminated on the heat-resistant sheet 114. Note that in this arrangement shown in FIG. 15, the fixing roller 112 and the pressure member 111 has a greater distance therebetween as a result. Therefore, the thickness of the metal foil is preferably not more than 100 μm, more preferably 40 μm to 70 μm.

Therefore, to making the arrangement simpler while to ensure an appropriate nip width, it is preferable that the heat-resistant sheet itself has a function of reducing thermal deformation, and it is more preferable that thermal deformation is reduced with the use of the thermal deformation reducing section such as a slit or a slash with which it is possible to absorb changes in the volume of the heat-resistant sheet due to heat.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fixing device comprising:

a fixing roller;

a heat-resistant sheet, provided in contact with said fixing roller, having a thermal deformation reducing section for reducing deformation due to heat; and a pressure member, depressed against said fixing roller with said heat-resistant sheet therebetween, wherein a recording material bearing a prefixed toner image is transported between said fixing roller and said heat-resistant sheet so that the prefixed toner image is fixed onto the recording material.

2. The fixing device as defined in claim 1, wherein the thermal deformation reducing section is designed to reduce deformation of said heat-resistant sheet by absorbing changes in volume of said heat-resistant sheet due to heat.

3. The fixing device as defined in claim 1, wherein the thermal deformation reducing section is composed of at least one slit.

4. The fixing device as defined in claim 3, wherein the slit is designed to tilt with respect to the transporting direction of the recording material.

5. The fixing device as defined in claim 3, wherein the slit has a substantially triangular shape.

6. The fixing device as defined in claim 3, wherein the slit has a substantially trapezoidal shape.

7. The fixing device as defined in claim 3, wherein a slit width of the slit is set depending on a thermal expansion coefficient of said heat-resistant sheet.

8. The fixing device as defined in claim 7, wherein the slit width is set so as to satisfy:

$$\Delta L = \alpha \cdot L \cdot T$$

where ΔL represents a slit width at normal temperature, α represents a thermal expansion coefficient of said heat-resistant sheet, L represents a slit interval at normal temperature, and T represents a temperature rise of said heat-resistant sheet.

9. The fixing device as defined in claim 3, wherein an interval between the adjacent slits is set depending on a thermal expansion coefficient of said heat-resistant sheet.

10. The fixing device as defined in claim 3, wherein an interval between the adjacent slits is not more than 110 mm.

11. The fixing device as defined in claim 1, wherein said heat-resistant sheet is made of a fluororesin.

12. The fixing device as defined in claim 11, wherein the fluororesin is tetrafluoroethylene-perfluoroalkylvinylether copolymer resin.

13. The fixing device as defined in claim 11, wherein the fluororesin is polytetrafluoroethylene.

14. The fixing device as defined in claim 1, wherein said fixing roller is designed to contact said heat-resistant sheet at a center portion of the thermal deformation reducing section.

15. The fixing device as defined in claim 1, wherein the thermal deformation reducing section is composed of at least one slit and at least one slash provided adjacent to the slit.

16. The fixing device as defined in claim 15, wherein the slash is longer than twice a contact width of said heat-resistant sheet and said fixing roller.

17. The fixing device as defined in claim 1, wherein the thermal deformation reducing section is composed of at least one slash.

18. The fixing device as defined in claim 17, wherein the slash is provided at the center portion of said heat-resistant sheet in the recording-material transporting direction.

19. The fixing device as defined in claim 17, wherein an interval between the adjacent slashes is determined depending on a thickness of said heat-resistant sheet.

20. The fixing device as defined in claim 17, wherein an interval between the adjacent slashes is not less than twice a thickness of said heat-resistant sheet and not more than ten times the thickness of said heat-resistant sheet.

21. The fixing device as defined in claim 17, wherein a length of the slash is not less than twice a contact width of said heat-resistant sheet and said fixing roller.

22. The fixing device as defined in claim 17, wherein:

said heat-resistant sheet is produced by rolling a material sheet; and the slash is provided not parallel to a rolling direction of the material sheet.

23. The fixing device as defined in claim 1, wherein a paper-transporting force of said fixing roller is not less than 300 gf, the paper-transporting force being measured by pulling in a reverse direction the recording medium transported by said rotating fixing roller and decreasing the pulling force till the transportation of the recording medium resumes, the paper-transporting force being a value detected when the transportation resumes.

24. The fixing device as defined in claim 23, wherein a paper-transporting force of said fixing roller is 350 gf.

25. The fixing device as defined in claim 1, wherein only an end portion of said heat-resistant sheet in an upstream side in a recording-material-transporting direction is fixed to a frame constituting said fixing device.

* * * * *